US006332570B2

(12) United States Patent
Frei

(10) Patent No.: US 6,332,570 B2
(45) **Date of Patent: *Dec. 25, 2001**

(54) FLAT TRANSPARENT MAGNIFYING ENVELOPE

(76) Inventor: Willi Frei, Via al Tazzino, 7A, Locarno CH-6600 (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/451,195

(22) Filed: Nov. 29, 1999

(51) Int. Cl.[7] ..... B65D 27/00
(52) U.S. Cl. ..... 229/67.1; 229/71; 359/807
(58) Field of Search ..... 229/67.1, 71; 359/807

(56) References Cited

U.S. PATENT DOCUMENTS 3,142,437 * 7/1964 Grant et al. ..... 229/67.1
4,805,680 * 2/1989 Ueno et al. ..... 150/147
4,861,073 * 8/1989 Poretsky ..... 281/45
4,863,026 * 9/1989 Perkowski ..... 206/387
5,333,907 * 8/1994 Schaffer ..... 281/42
5,471,347 * 11/1995 Galiani ..... 359/807
5,610,770 * 3/1997 Galiani ..... 359/807
5,894,365 * 4/1999 Gasper ..... 359/474

* cited by examiner

*Primary Examiner*—Jes F. Pascua
(74) *Attorney, Agent, or Firm*—Fish & Associates, LLP; Robert D. Fish

(57) ABSTRACT

A flat transparent envelope has a rectangular, transparent cover sheet and a rectangular, preferably transparent backsheet. The cover sheet and backsheet are preferably flexible films that are joined together along at least two but no more than three of the sheet edges so that the envelope is open along at least one of the sheet edges and the edges of the joined sheets are situated in the envelope plane. The transparent cover sheet and backsheet may advantageously be entirely formed of a magnifying material.

12 Claims, 1 Drawing Sheet

FIG. 1
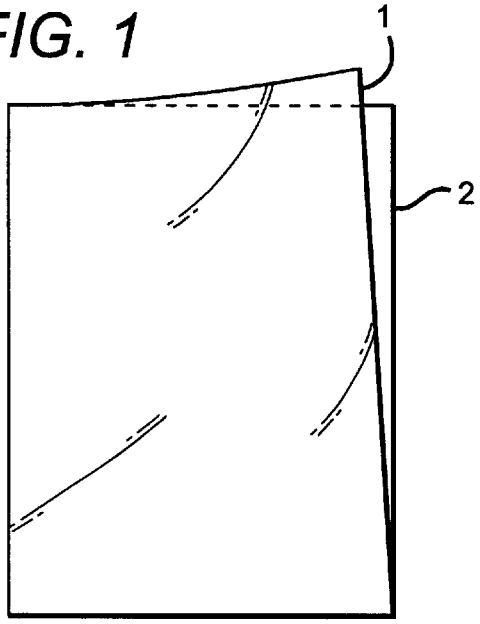
FIG. 2
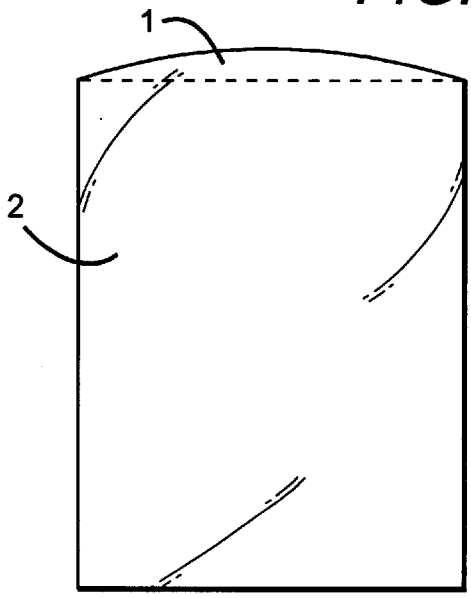
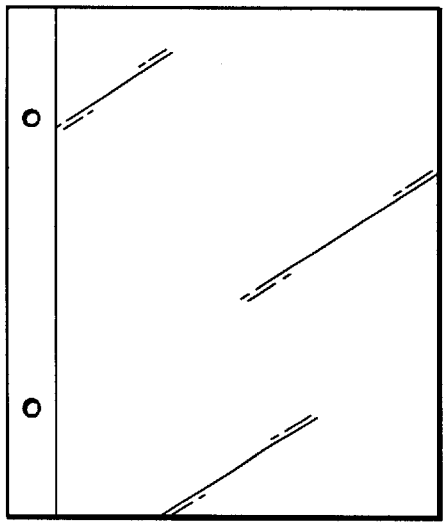
FIG. 3

FLAT TRANSPARENT MAGNIFYING ENVELOPE

The invention relates to a flat transparent envelope, in particular to a flat transparent envelope comprising a rectangular, transparent cover sheet and a rectangular, preferably transparent backsheet, where the cover sheet and the backsheet are flexible films joined together along at least two but no more than three of their edges so that the envelope is open along at least one of the sheet edges and the edges of the joined sheets are situated in the envelope plane, In everyday life it is often necessary to safely keep written or printed sheets of paper, pictures, plastic, foils or similar objects. Experience has shown that it is; useful to place a sheet or a small number of sheets of similar content in a flat protective envelope. The protective envelope comprises a rectangular cover sheet and a rectangular back sheet, the cover sheet and the back sheet being flexible films. The cover sheet and the, back sheet are joined together along two of the edges so that the envelope is open along two of the sheet edges and the joined sheets are situated in the envelope plane.

Also, flat protective envelopes are known where the cover sheet and the backsheet are joined together along three of the sheet edges so that the envelope is open along one of the sheet edges.

The cover sheets of many flat protective envelopes are transparent so that the viewer is able to see the sheet on top through the cover sheet. Such a flat protective envelope the cover sheet of which is transparent is called a flat transparent envelope hereinafter.

If several sheets are placed in such a flat transparent envelope it is of advantage to place a sheet on top which contains a summary or a key word and/or a picture characterizing the content so that the viewer quickly gets an overview of the content of the sheets placed in the flat transparent envelope.

With transparent envelopes according to prior art there exists the problem that people with bad eye-sight are often unable to clearly recognize or read the characters and/or pictures shown on the top sheet. Moreover, the letters of many printed documents are so small that even people with normal eye-sight often have difficulties in reading such documents. Also, unfavourable light conditions can be the cause that people with normal eye-sight can only recognize characters and/or pictures shown on the top sheet by trying very hard and involving more time than usual. People with bad eye-sight are no longer able to recognize the characters and/or pictures shown on the top sheet if such bad light conditions are given.

The invention solves the problem to provide a new type of transparent envelope. By means of the transparent envelope according to the invention a text and/or a picture on the top sheet placed in the transparent envelope can be easily and clearly recognized, in particular by people with bad eye-sight.

The problem is solved by means of a flat transparent envelope with a rectangular, transparent cover sheet and a rectangular, preferably transparent backsheet, said cover sheet and said backsheet being flexible films joined together along at least two but no more than three of the sheet edges so that the envelope is open along at least one of the sheet edges and the edges of the joined sheets are situated in the envelope plane, and the transparent cover sheet is entirely formed of magnifying material.

Films made of magnifying material are known as such. Magnifying material is a transparent, optical magnifying film which is formed in such a way that an object seen through the magnifying film is perceived as optically enlarged by the viewer if there is a space between the magnifying film and the object. The magnifying film is therefore forming an optical lense, the optical magnification being determined by the space between the magnifying material and the object being looked at, said space being adjusted by raising the cover sheet.

The optical magnification of the content of a top sheet placed in the flat transparent envelope according to the invention can therefore be adjusted by raising the cover sheet. if there is no space between the cover sheet and the top sheet, the characters and/or pictures shown on the top sheet are not magnified and are perceived by the viewer in their actual size.

If the sheets placed in the flat transparent envelope according to the invention are smaller than the cover sheet and smaller than the backsheet so that the cover sheet and the backsheet completely cover the sheet placed on top or at the bottom, respectively, the sheets kept in the transparent envelope are well protected against all kinds of possible damages.

It is especially advantageous that the flat transparent envelope according to the invention is flexible and, contrary to rigid protective envelopes, can be seriously deformed without being damaged.

With a further embodiment of the flat transparent envelope according to the invention it is possible to additionally form the backsheet from magnifying material so that also the reverse of the sheet placed at the bottom can be optically magnified. This is especially advantageous when the transparent envelope is used as a protective envelope for a single page with writing or printing on both sides.

In some cases it is useful to store the flat transparent envelope according to the invention in a ring binder. For that reason the flat transparent envelope according to the invention. can be provided with a filing strip along one of the sheet edges joined together, said filing strip being provided with at least two holes at such a distance that the flat transparent envelope can be filed by using common filing means. The filing strip is preferably formed as rectangular, flexible strip of film.

In the following the invention is described by means of preferred embodiments and by referring to the drawing. The drawing shows in FIG. 1 a perspective view of a first embodiment of the flat transparent envelope according to the invention, FIG. 2 a perspective view of a second embodiment of the flat transparent envelope according to the invention, and FIG. 3 a top view of a flat transparent envelope according to a third embodiment of the invention.

From FIG. 1 a perspective view of a flat transparent envelope according to a first embodiment of the invention can be taken. The transparent envelope comprises a rectangular, transparent cover sheet 1 and a rectangular, preferably transparent backsheet 2, the cover sheet 1 and the backsheet 2 consisting of equally sized, flexible films which exactly overlie each other. Further, the cover sheet 1 and the backsheet 2 are joined together along two of the sheet edges so that the envelope is open along two of the sheet edges, the edges of the joined sheets being situated in the envelope plane. The transparent cover sheet 1 consists entirely of a magnifying material.

Such a flat transparent envelope is preferably used as protective envelope for sheets being quickly placed therein as fLor doing so it is only required to raise the cover sheet 1. Also, the magnification can be continuously adjusted by raising the cover sheet over the largest area thereof.

From FIG. 2 a perspective view of a flat transparent envelope according to a second embodiment of the invention can be taken. The cover sheet 1 and the backsheet 2 are joined together along three of the sheet edges so that the envelope is open along one'sheet edge. Otherwise, this embodiment corresponds to the first embodiment according to FIG. 1.

Such a flat transparent envelope is preferably used as protective envelope for receiving a small number of sheets which are to be protected against slipping from the flat transparent envelope, for example when being transported. The magnification can he continuously adjusted by raising the cover sheet over a large area thereof.

From FIG. 3 a top view of a flat transparent envelope according to a third embodiment of the invention can be taken, the flat transparent envelope according to the invention being provided with a filing strip having at least 2 holes which are arranged at such a distance from each other that the transparent envelope can be filed by using common filing means. The filing strip is preferably formed as rectangular, flexible film strip.

What is claimed is:

1. An envelope, comprising:

a flexible and transparent cover sheet having a first edge and a second edge, wherein the cover sheet is a magnifying film;

a flexible back sheet having a first edge and a second edge; and wherein the first edge and the second edge of the cover sheet are directly joined to the first edge and the second edge of the back sheet to form a flexible envelope such that an object disposed between the cover sheet and back sheet is not magnified when the cover sheet and back sheet rest on the object, and that the object is magnified when a user raises the cover sheet from the object.

2. The envelope of claim 1 wherein the cover sheet has a third edge and the back sheet has a third edge, and wherein the third edge of the cover sheet is joined to the third edge of the back sheet.

3. The envelope of claim 1 wherein the back sheet is transparent.

4. The envelope of claim 2 wherein the back sheet is transparent.

5. The envelope of claim 3 wherein the back sheet comprises a magnifying film.

6. The envelope of claim 4 wherein the back sheet comprises a magnifying film.

7. The envelope of claim 5 wherein the back sheet is a magnifying film.

8. The envelope of claim 6 wherein the back sheet is a magnifying film.

9. The envelope of claim 2 wherein at least one of the cover and the back sheet are rectangular.

10. The envelope of claim 2 further comprising a filing strip coupled to at least one of the back sheet and the front sheet.

11. The envelope of claim 1 wherein at least one of the cover and the back sheet are rectangular.

12. The envelope of claim 1 further comprising a filing strip coupled to at least one of the back sheet and the front sheet.

* * * * *

UNITED STATES PATENT AND TRADEMARK OFFICE

CERTIFICATE OF CORRECTION

PATENT NO. : 6,332,570 B2
DATED : December 25, 2001
INVENTOR(S) : Willi Frei

It is certified that error appears in the above-identified patent and that said Letters Patent is hereby corrected as shown below:

Title page,
Item [54], replace "FLAT TRANSPARENT MAGNIFYING ENVELOPE" with -- FLAT TRANSPARENT ENVELOPE --.

Signed and Sealed this

Twenty-second Day of April, 2003

JAMES E. ROGAN
*Director of the United States Patent and Trademark Office*